US007963470B2

(12) United States Patent
Hunter

(10) Patent No.: US 7,963,470 B2
(45) Date of Patent: Jun. 21, 2011

(54) DISCHARGE FROM GRINDING MILLS

(76) Inventor: James William Hunter, Wyoming (AU)

( * ) Notice: Subject to any disclaimer, the term of this patent is extended or adjusted under 35 U.S.C. 154(b) by 0 days.

(21) Appl. No.: 12/797,020

(22) Filed: Jun. 9, 2010

(65) Prior Publication Data

US 2010/0270405 A1 Oct. 28, 2010

Related U.S. Application Data

(63) Continuation of application No. 10/558,517, filed on Nov. 28, 2005, now Pat. No. 7,757,986.

(51) Int. Cl.
*B02C 23/16* (2006.01)

(52) U.S. Cl. ..... 241/69; 241/175

(58) Field of Classification Search ..... 241/69, 241/73, 175

See application file for complete search history.

(56) References Cited

U.S. PATENT DOCUMENTS

| | | | | |
|---|---|---|---|---|
| 4,742,966 | A * | 5/1988 | Szkaradek et al. | 241/69 |
| 5,011,089 | A * | 4/1991 | Vock et al. | 241/21 |
| 5,785,262 | A * | 7/1998 | Tippett | 241/74 |
| 7,070,134 | B1 * | 7/2006 | Hoyer | 241/171 |
| 7,757,986 | B2 * | 7/2010 | Hunter | 241/69 |

* cited by examiner

*Primary Examiner* — Jimmy T Nguyen

(74) *Attorney, Agent, or Firm* — Marshall, Gerstein & Borun LLP; Richard M. LaBarge

(57) ABSTRACT

A screening element can be mounted at a discharge passage of a grinding mill chamber. The discharge passage is positioned in use to receive ground particles moving thereinto in a discharge direction. The screening element comprises one or more openings defined therein that are oriented such that ground particles pass therethrough in a direction that is oblique with respect to the discharge direction. The grinding mill chamber may form part of a centrifugal grinding mill.

20 Claims, 7 Drawing Sheets

DISCHARGE FROM GRINDING MILLS

This is a continuation of application Ser. No. 10/558,517, filed Nov. 28, 2005, now U.S. Pat. No. 7,757,986.

TECHNICAL FIELD

This disclosure relates to the discharge of ground particles from grinding mills such as centrifugal grinding mills.

BACKGROUND TO THE DISCLOSURE

Centrifugal grinding mills are employed for the comminution of solid particles, for example, mineral ores. Compared with tumbling mills (which are limited by gravitational acceleration), centrifugal grinding mills impart centrifugal acceleration to the mill contents as a consequence of a gyrating motion, greatly enhancing the rate of comminution. The resultant higher velocity of mill contents can more readily lead to blockages at discharge.

SUMMARY OF THE DISCLOSURE

In this disclosure there is firstly provided a screening element for mounting at a discharge passage of a grinding mill chamber. The discharge passage is positioned in use to receive ground particles moving thereinto in a discharge direction. The screening element comprises one or more openings defined therein which are oriented such that ground particles pass therethrough in a direction that is oblique with respect to the discharge direction.

The terms "oblique" and "obliquely" are to be construed herein as including the case where the ground particles can pass through the one or more openings in a direction that is orthogonal with respect to the discharge direction.

By orienting the one or more openings in a manner that results in an oblique direction of passage, it has been observed that the discharge of ground particles (i.e. resulting from the milling of a feed to the mill) can be better facilitated and the blockage of openings in the discharge passage, by e.g. grinding media and/or oversize feed particles, can be mitigated, ameliorated or avoided. Hereafter, any grinding media or any oversize feed particles present in the discharge passage will collectively be referred to as "coarse particles".

In one embodiment each of the one or more openings itself is oriented obliquely with respect to the discharge direction.

In another embodiment the screening element opening(s) are sized such that the coarse particles (including grinding media) are prevented from discharging from the passage whereas fine ground particles are permitted to discharge from the passage. The terminology "fine ground particles" refers to particles having a predetermined size to enable subsequent use and/or further classification. This predetermined size can be regulated by controlling the size of screening element opening(s).

In one embodiment a plurality of openings are provided in the screening element.

In one embodiment the screening element comprises at least one annular plate mountable at the discharge passage, with a discharge passage backing plate being mountable adjacent to but spaced from the annular plate that is most remote from the chamber. A screening element opening can be defined between the backing plate and adjacent annular plate and/or between the chamber and annular plate adjacent thereto. In this embodiment a plurality of annular plates can be mounted adjacent to but spaced from each other to define a plurality of openings therebetween. In addition, each of the hacking and annular plates may be of substantially lamina form.

In this embodiment, to define the screening element between the backing plate and the chamber, the one or more annular plates and the backing plate can be fastened together by one or more fixing elements. The one or more fixing elements effectively clamp the assembly of one or more annular plates between the backing plate and a wall of the grinding chamber, with the backing plate being positioned adjacent and clamped to the annular plate most remote from the wall of the grinding chamber.

For example, each fixing element can comprise an elongate pin or bolt extending through respective aligned holes in the one or more annular plates and the backing plate, with a proximal end (e.g. head) of each pin or bolt being received at the backing plate, and a distal end of each pin or bolt being mountingly received in an external wall of the grinding mill chamber adjacent to the discharge passage. In this regard, the distal end of each pin or bolt can be externally threaded for engagement in a respective threaded recess in the chamber wall adjacent to discharge passage. The or each fixing element may alternatively comprise a clamp or the like.

In this embodiment the one or more annular plates can be spaced from each other, and/or the backing plate and the annular plate adjacent thereto can be spaced from each other, by one or more respective spacers which define one or more screening element openings between adjacent annular plates and/or the backing plate and the annular plate adjacent thereto and/or between the chamber and annular plate adjacent thereto.

In this embodiment the spacers can be formed integrally with each plate. In another embodiment, the one or more spacers can be a plurality of washers discretely arranged in the space between and around the periphery of the one or more annular plates. In this regard, to better facilitate spacer location, each spacer (e.g. each washer) can be located on or at a respective elongate pin or bolt. Each spacer can then be clamped between adjacent plates.

The length of the screening element can thus be determined by the number of annular plates and/or the size of spacers employed between the backing plate and chamber wall. For example, spacers can be employed such that their thickness varies regularly or irregularly, to provide for control of and/or variation in the size of the or each screening element opening.

As a further variation, the plurality of annular plates can be configured such that their internal diameter can be varied regularly or irregularly. For example, moving away from the chamber, a progressive decrease in the internal diameter of a plurality of annular plates can provide a slope to an internal passage of the screening element, and this slope can tend to cause coarse particles to be urged back into the grinding chamber.

Thus, a variety of screening element internal passage shapes can be achieved, and these can be selected to maximise fine ground particle release and to cause coarse particle return to the grinding chamber.

In addition, the or each annular plate can be formed from a resilient or flexible material that can deform or flex under impact and thus cause coarse particles to be deflected back into the grinding chamber. The deformable or flexible annular plates also enable blockage clearance to be effected without dismantling of the screening element.

Optionally or additionally, the spacers and/or fixing elements (e.g. bolts or pins) can be formed from a resilient or flexible material that can be caused to deform or flex under impact on the or each annular plate and/or backing plate, again causing coarse particle return to the grinding chamber and enabling blockage clearance to be effected without dismantling.

In addition, where the or each annular plate is formed from a resilient or flexible material, the plate(s) can deform or flex in accordance with dynamic forces imposed on these plates resulting from the in-use motion of the grinding chamber. This can induce a vibratory effect at the or each annular plate which can assist with the transport of ground particles through the screening element openings. In addition, the vibratory effect can inhibit or prevent entrapment of individual coarse particles in the screening element openings, thus preventing blockage.

When a plurality of annular plates is employed the screening element can thus define a type of grate which has a series of openings, wherein each opening can be oriented obliquely with respect to the discharge direction.

Optionally, a grate can be defined in the backing plate, such that one or more additional openings are provided. The additional openings may or may not be oriented obliquely to the lateral direction. The additional openings can, for example, comprise a plurality of apertures of tubular form extending through the backing plate. In any case, in this embodiment, the one or more additional openings may be sized such that ground particles can be released therethrough but coarse particles cannot.

Where additional openings are employed in the backing plate, they can be selectively configured to enable a predetermined discharge proportion of fine ground particles moving through the discharge passage in a direction substantially parallel to the elongate axis of the discharge passage. In this regard, the additional openings can be employed to allow for the discharge of some fine ground particles moving in the discharge direction.

When, for example, the grinding chamber has a longitudinal axis, the discharge direction can be represented as a vector that is inclined or generally orthogonal to the chamber axis in use. In yet another embodiment the grinding chamber has a longitudinal axis of symmetry, and the discharge direction is generally inclined or orthogonal to this axis of symmetry in use.

In addition, the or each screening element opening may be oriented such that ground particles pass obliquely (e.g. orthogonally) therethrough with respect to the discharge direction vector. For example, where the discharge passage defines an elongate axis therethrough, the discharge direction vector typically aligns with this axis, and the ground particles can pass through the or each screening element opening in a direction that is oblique (for example, normal) to the discharge passage elongate axis.

Further, where the discharge passage defines an elongate axis, the or each annular plate and backing plate can be spaced apart along the elongate axis to define a series of annular screening element openings of cylindrical form, symmetrical about the elongate axis.

Again, where the discharge passage defines an elongate axis, the radial thickness of the annular plates can reduce, moving outwardly from the elongate axis of the discharge passage. Accordingly, moving outwardly from the elongate axis of the discharge passage, the transverse dimension of the screening element openings can increase.

In an embodiment the elongate axis of the or each discharge passage may be substantially normal to a wall of the grinding chamber.

In this disclosure there is secondly provided a grinding mill comprising one or more screening elements as defined above. The grinding mill may be a centrifugal grinding mill, for example, a centrifugal grinding mill as defined hereafter.

In this disclosure there is thirdly provided a grinding mill comprising:

a grinding chamber;

a support for supporting the grinding chamber;

a feed passage in communication with the grinding chamber for directing into the chamber a feed to be ground;

at least one discharge passage for receiving in a discharge direction ground feed particles from the grinding chamber and for discharging the particles therefrom;

a drive mechanism coupled to drive the grinding chamber in a manner that causes any grinding media and/or the feed in the chamber to grind the feed and produce the ground feed particles; and at least one corresponding screening element for mounting at the discharge passage, the screening element comprising one or more openings defined therein which are oriented such that ground feed particles can pass therethrough in a direction that is oblique with respect to the discharge direction.

The one or more screening elements may be configured as defined above. Furthermore, the one or more screening elements can be mounted externally of the grinding chamber and disposed about a longitudinal axis of the discharge passage. The one or more screening elements may also be configured to permit at least fifty percent of the fine particles of ground product to discharge from the chamber in a direction substantially normal to the axis of the discharge passage.

In one embodiment the grinding mill is a centrifugal grinding mill and the grinding chamber has a longitudinal axis of symmetry. Further, the grinding chamber can be mounted to the support such that, when driven, a nutating motion of the axis of symmetry about a relatively stationary axis of the grinding mill occurs, with the axes intersecting at a point of nutation symmetry. In this embodiment the grinding chamber axis can be inclined to and intersect with the axis of rotation of the chamber, to produce the nutating motion.

In this specification nutating motion of a machine element relative to a fixed frame will be defined as the motion of an axis of the element such that it intersects with and traces out a conical surface about a stationary axis of the fixed frame. In the general case, the nutating element has a net rotational motion about its axis, relative to the fixed frame. A special case of nutating motion is one in which the nutating element has not net rotational motion about its axis, relative to the fixed frame. This special case can be achieved by employing a torque restraint mechanism, as described below.

In an embodiment the grinding chamber comprises a constraint mechanism having annular bearing surfaces which engage with complementary opposing bearing surfaces at the support. The opposing bearing surfaces may be symmetrical about the point of nutation symmetry, and can limit the amplitude of nutating motion.

In another embodiment the drive mechanism comprises a drive shaft having an axis substantially co-linear with the stationary axis of nutating motion, with a proximal end of the drive shaft being driven by a power transmission unit connected therewith. The drive shaft can be provided with a cantilevered eccentric stub shaft mounted at its distal end and located adjacent to the grinding chamber. The stub shaft can have an axis substantially co-linear with the axis of symmetry of the grinding chamber. The eccentric stub shaft can engage the grinding chamber through an intermediate bearing element adapted to permit relative rotational motion about the chamber axis of the stub shaft and grinding chamber.

In this disclosure this is fourthly provided a method of discharging particles from a grinding mill chamber, where the particles are initially discharged from the chamber in a discharge direction, the method comprising the step of altering particle direction once the particles have discharged from the chamber to a direction that is oblique with respect to the discharge direction and then discharging the particles.

In this method the particle direction can be altered by positioning a screening element adjacent to where the particles are initially discharged from the chamber. The screening element can be adapted to receive the discharged particles and may be an element as defined above. In this method the grinding mill chamber can form part of a grinding mill as defined above.

BRIEF DESCRIPTION OF THE DRAWINGS

Centrifugal grinding mills, including screening elements, will now be described, by way of example only, with reference to the accompanying drawings in which.

DETAILED DESCRIPTION OF SPECIFIC EMBODIMENTS

Figure 1:
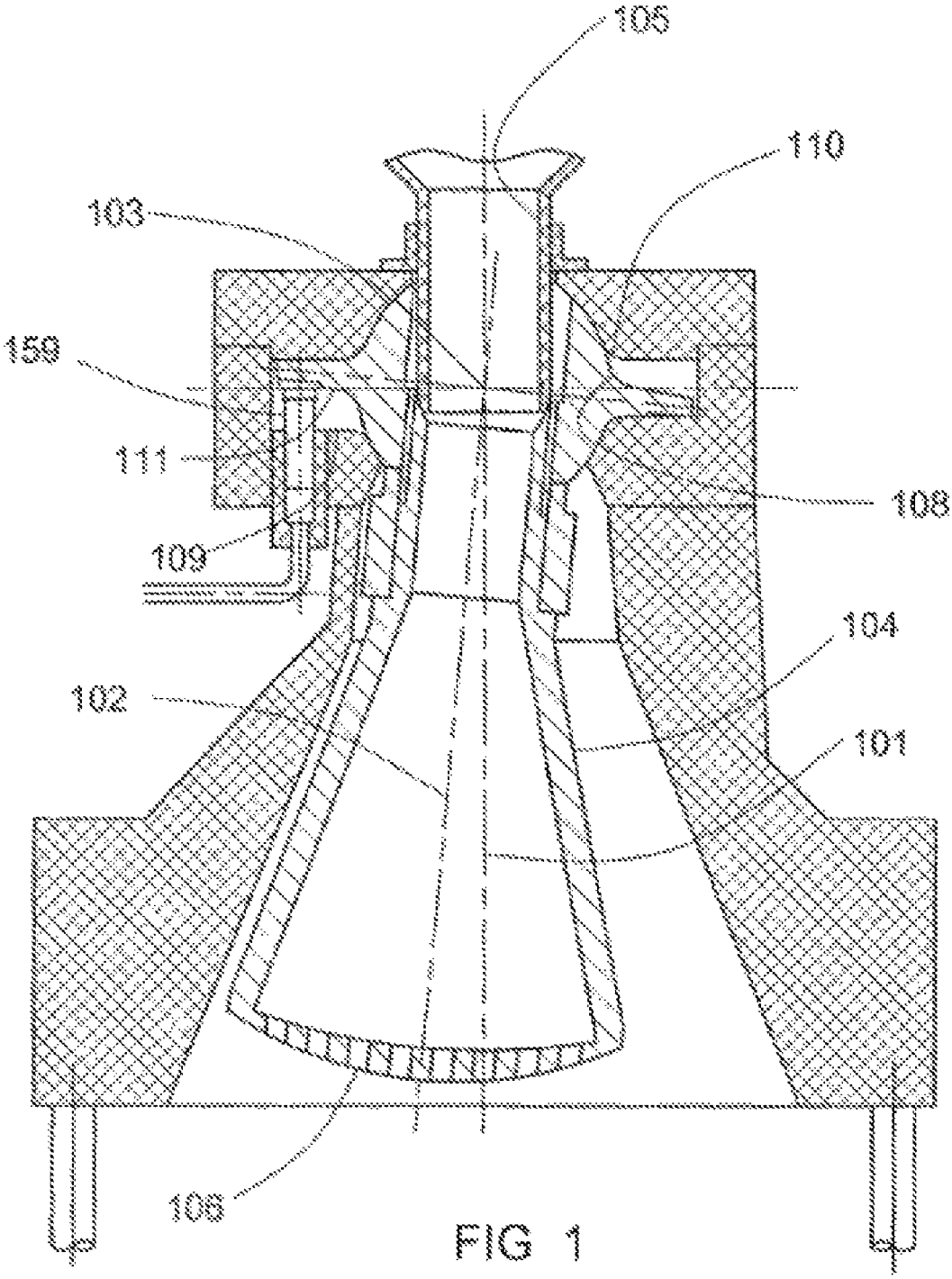
FIG 1 Prior Art
FIGS. 1 and 2 are schematic sectional views of two known centrifugal grinding mill arrangements.
Figure 2:
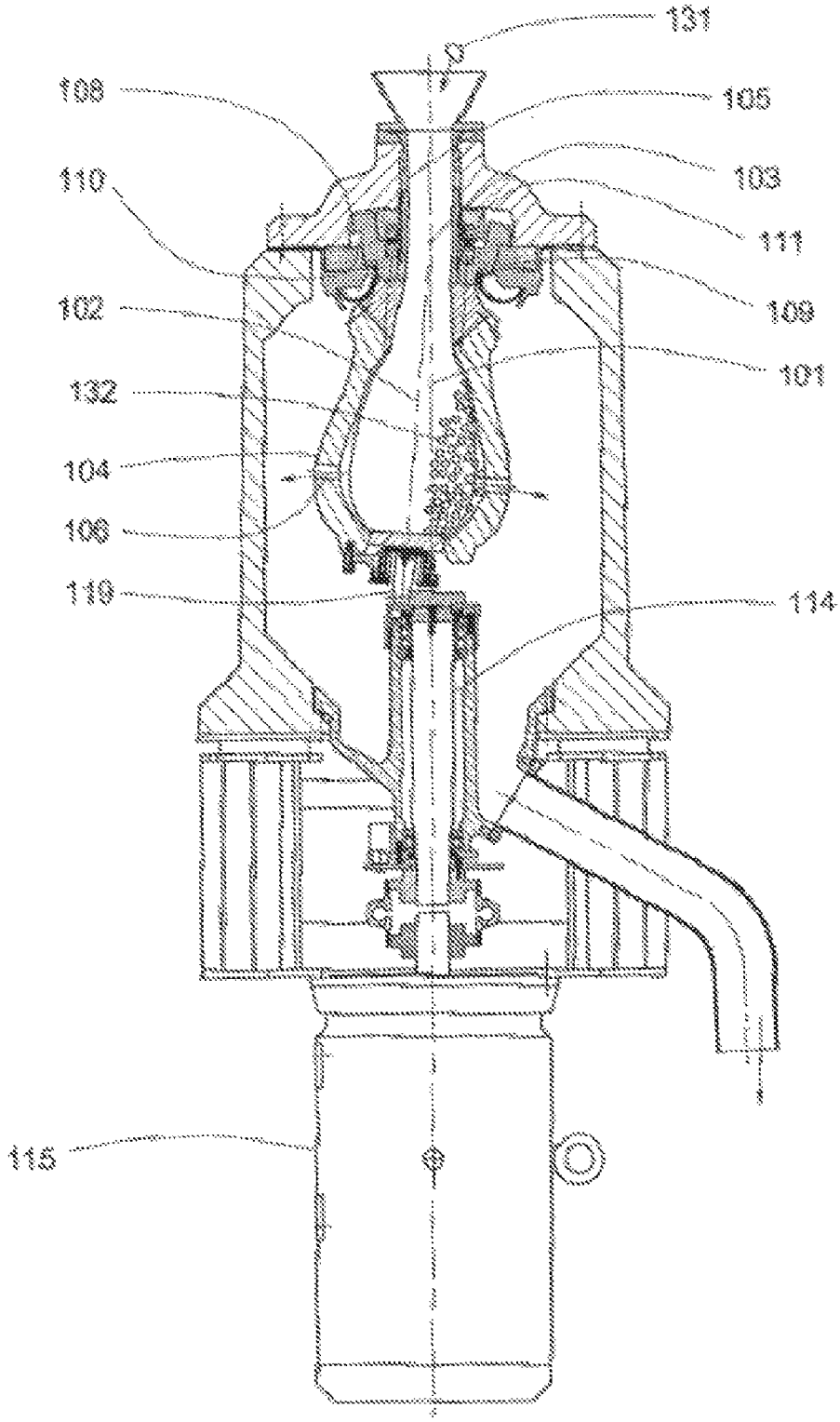
FIG 2 Prior Art

Referring firstly to FIGS. 1 and 2, cross sections through two known centrifugal grinding mills are shown. Screening element arrangements as described below can be employed with either of the grinding mills depicted in FIGS. 1 and 2, and may also be employed with other grinding mill arrangements.

Each of FIGS. 1 and 2 shows a grinding chamber 104, having an axis of symmetry 102, which rotates about a fixed axis 101, and intersects therewith at a point of nutation symmetry 103. The chamber is constrained to perform nutating motion by the engagement of complementary annular bearing surface pairs 109 and 111, and 108 and 110, which together form a bearing that is symmetrical about the point of nutation symmetry 103. This bearing limits the amplitude of nutating motion.

Feed material, typically in the form of a dry coarse granular material 131, or as a suspension of coarse particles in a fluid, or as a combination of both of these alternatives, is fed into the grinding chamber via the feed passage 105, and discharges from the opposite extremity of the grinding chamber via openings 106, as a fine (or refined) granular product. Screening element arrangements as described below can be employed with any of the openings 106.

In the embodiment shown in FIG. 1, the grinding chamber 104 is driven with a nutating motion about stationary axis 101 by multiple pistons 159 which are driven in phased sequence and bear against a flanged extension of the grinding chamber located about the point of nutation symmetry 103. In the embodiment shown in FIG. 2, the grinding chamber is driven with a nutating motion via a drive shaft 114, which is coupled to electric motor 115 at one end, and engages with the end of chamber 104 through an eccentric stub shaft 119 attached to the other end.

Rotation of the grinding chamber about its axis of symmetry may be prevented by a torque-restraining device connecting the grinding chamber to the support. For example, appropriate opposing gear plates can be arranged between the bearing surfaces 108, 110 and 109, 111 which mesh together and thus prevent such rotation. Such an arrangement is described below with reference to FIG. 4.

Typically, with the grinding mills depicted, the production of coarse and intermediate sized product material requires the use of grinding media 132. This media may have a typical size ranging from 5 to 20 mm spherical (or effective) diameter, which is typically larger than the size of the discharge passages 106 in the wall of the chamber 104. Particles of grinding media, together with unground or partially ground feed, are thus contained within the chamber, and only particles of ground feed material, or worn or small grinding media, having a size smaller than the openings 106, can discharge from the chamber.

Production of very fine product material, typically having 80 percent finer than 40 microns, requires the use of correspondingly fine grinding media, typically 1 to 5 mm spherical (or effective) diameter, for minimum energy consumption. The use of correspondingly small discharge passages 106 in the periphery of the grinding chamber 104 is not feasible. It has been discovered that the known discharge passages employed with centrifugal grinding mills, for example those mills shown in FIGS. 1 and 2, are unsuited to production of very fine product. For example, as the size of discharge passage is reduced, the likelihood of blockage by oversize particles increases inversely with the size of discharge passage. Furthermore, the very high surface pressures at the internal surface of the grinding chamber are not compatible with the structural or wear requirements of very fine discharge apertures.

Reference will now be made to FIGS. 3 to 7 in describing advantageous screening element arrangements which can address, inter alia, issues with blockage, overpressures, small grinding media etc, and provide for very fine product material.

Figure 3:
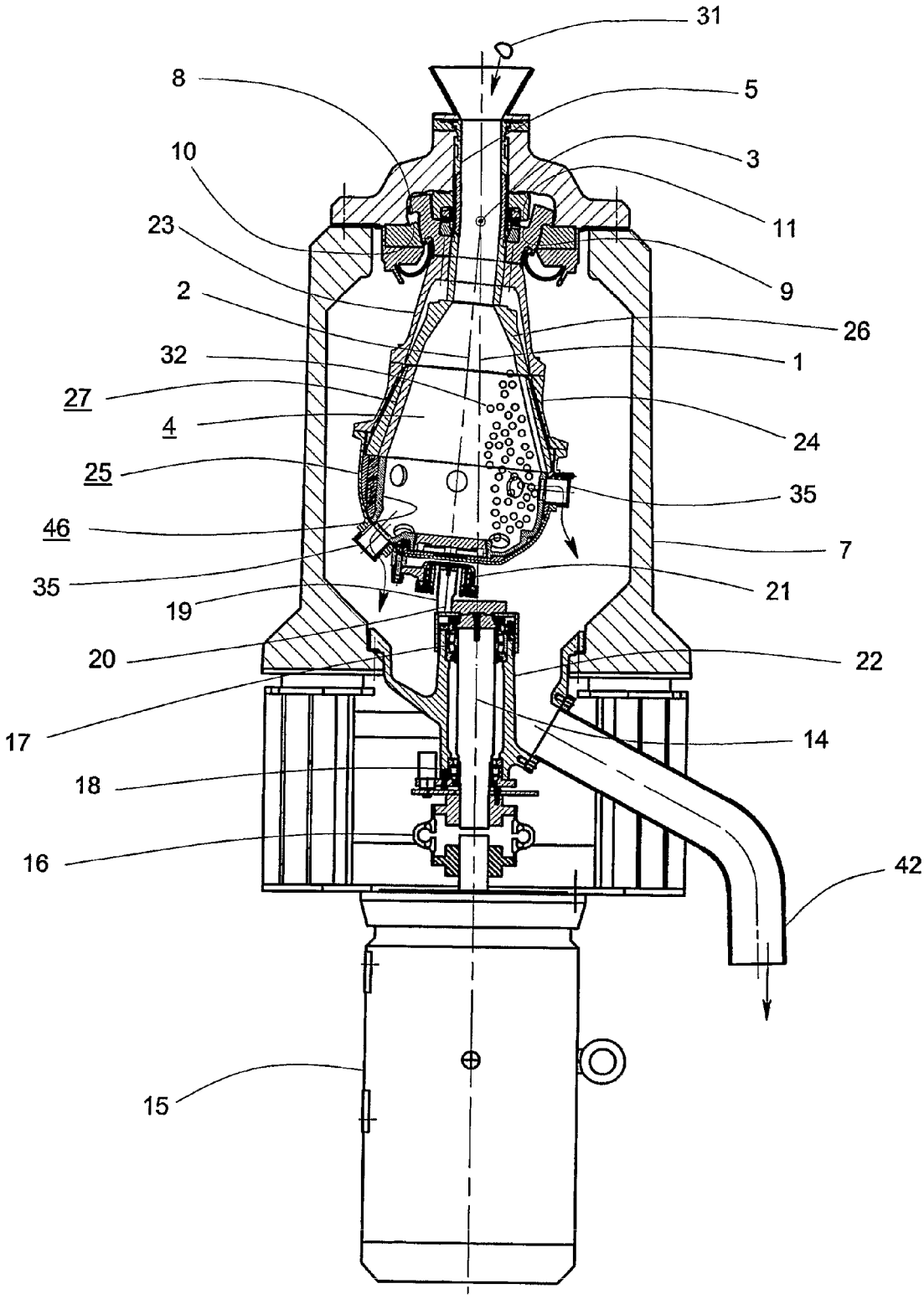
FIG. 3 is a sectional view of a centrifugal grinding mill according to a first embodiment.

FIG. 3 shows a centrifugal grinding mill comprising a vertical axis of revolution 1 (i.e. a stationary axis). A nutating axis 2 intersects axis 1 at a point of nutation symmetry 3. A grinding chamber 4, symmetrical about axis 2, is connected with a feed passage 5 at its upper end. The feed passage 5 intersects with an upper portion of the grinding chamber inner surface, and this intersection defines a plane which in turn defines an upper boundary to the grinding chamber, this boundary being located below the point of nutation symmetry 3.

Grinding chamber discharge passages 28 extend through the peripheral wall of the grinding chamber, and each passage has a screening element arrangement in the form of a screening module 35 mounted to the external wall of the grinding chamber and adjacent to the passage. Each module 35 has discharge openings 6 for discharging of fine product, as described below.

A support for the grinding chamber comprises a frame member (or members) 7 adapted to support the mill and transmit forces and moments generated by the mill to suitable foundations. To determine the form of nutating motion of the grinding chamber constraints are provided in the form of annular nutating bearing surfaces 8 and 9 rolling on corresponding fixed bearing surfaces 10 and 11, together with nutating and fixed part-spherical surfaces 12 and 13 respectively having centres coincident with point of nutation symmetry 3.

A drive is located below the grinding chamber comprising a drive shaft 14 adapted to be driven at its lower end by an electric motor 15 (or other power transmission device) through a flexible drive coupling 16. The drive shaft 14 is supported at its upper and lower ends by bearings 17 and 18 respectively which are mounted in a support casing 22 in turn mounted to frame member 7. The drive shaft 14 is connected to an eccentric stub shaft 19, the stub shaft being mounted at its upper end to an underside of grinding chamber 4. In this regard, the stub shaft has an axis 20 that is held coincident with the nutating axis 2 of the grinding chamber through the engagement of the stub shaft upper end with bearing 21, the bearing being mounted at the lower extremity of grinding chamber 4.

Figure 4:
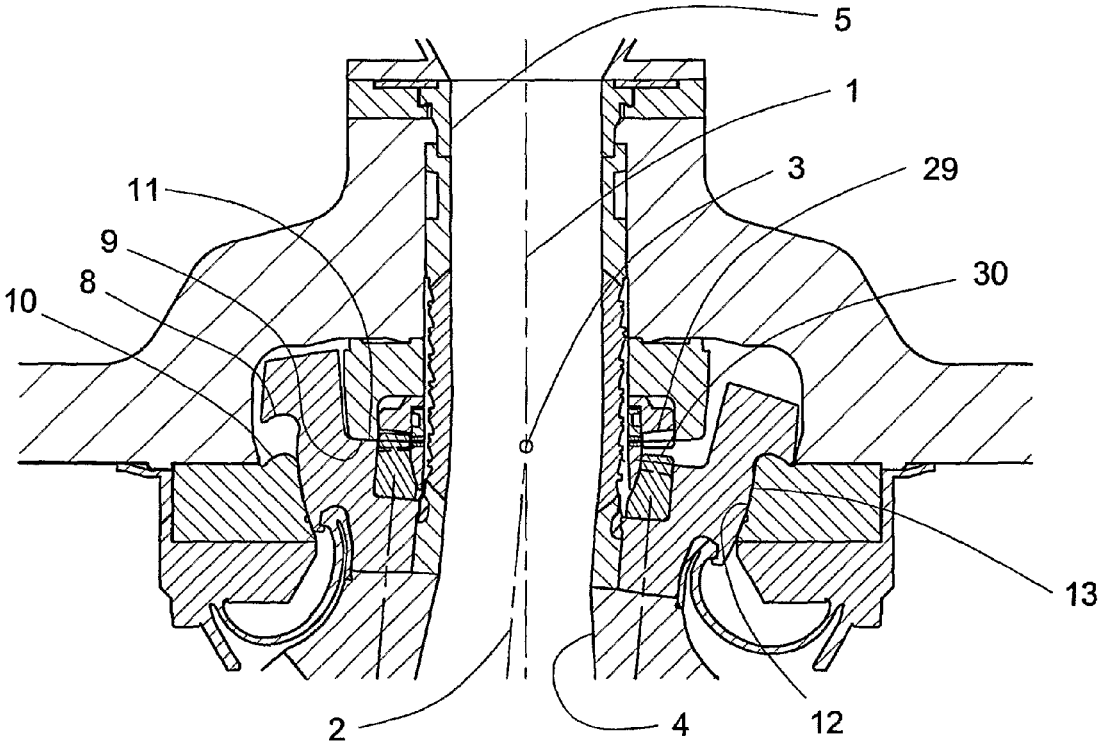
FIG. 4 is an enlarged sectional view of constraint and restraint mechanisms of the grinding mill of FIG. 3.

The grinding chamber 4 can be restrained from rotation about vertical axis 1 by intermeshing bevel gears 29 and 30 disposed about the point of nutation symmetry 3, as best shown in FIG. 4. Gear 30 fixed to grinding chamber 4, has nutating motion, and engages with stationary gear 29, to transfer (and thus restrain) torsional moment from the grinding chamber to the stationary frame 7.

Figure 5:
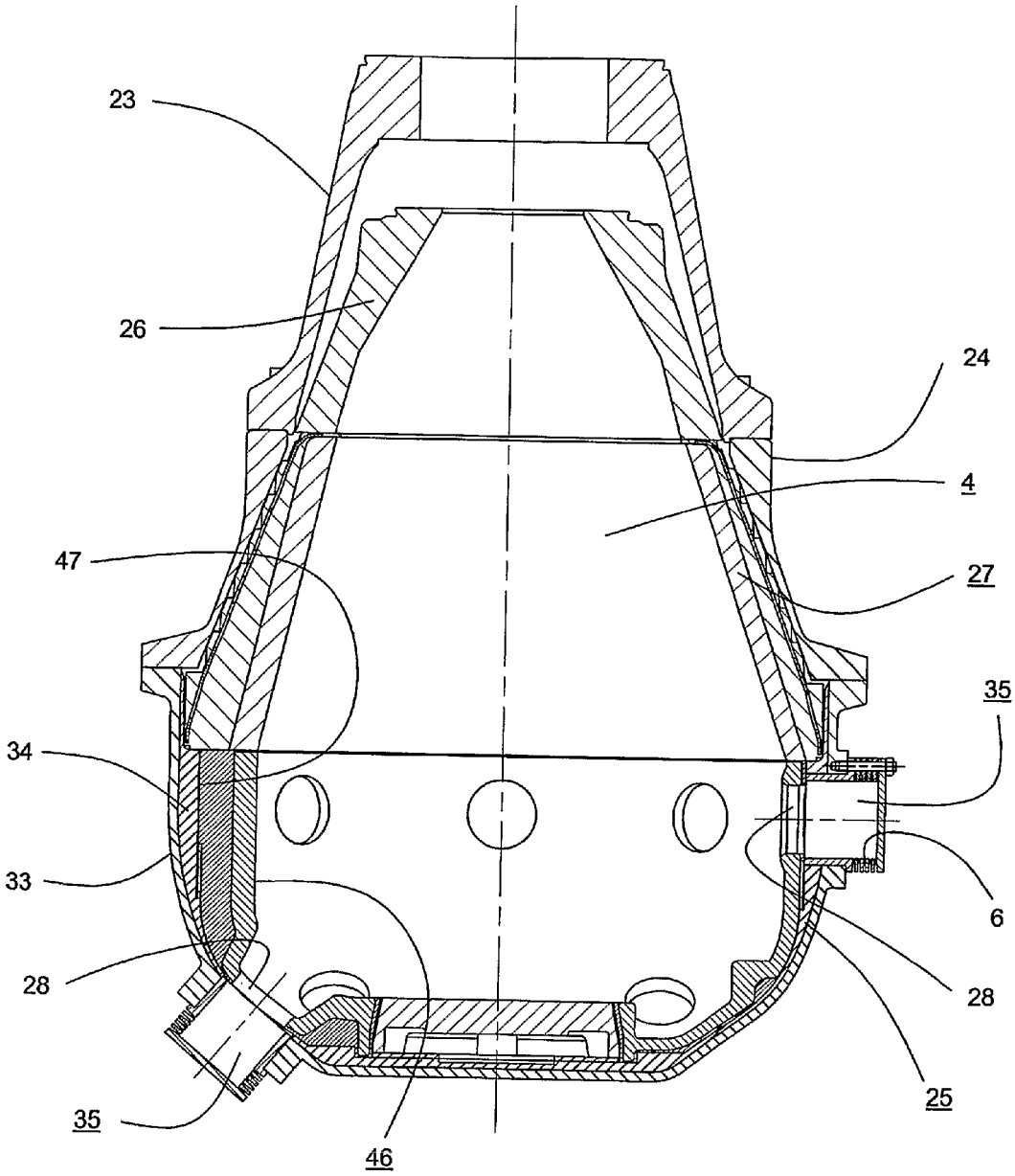
FIG. 5 is an enlarged sectional view of the grinding chamber, showing a screening module adapted to discharge fine product from the chamber.
Figure 6:
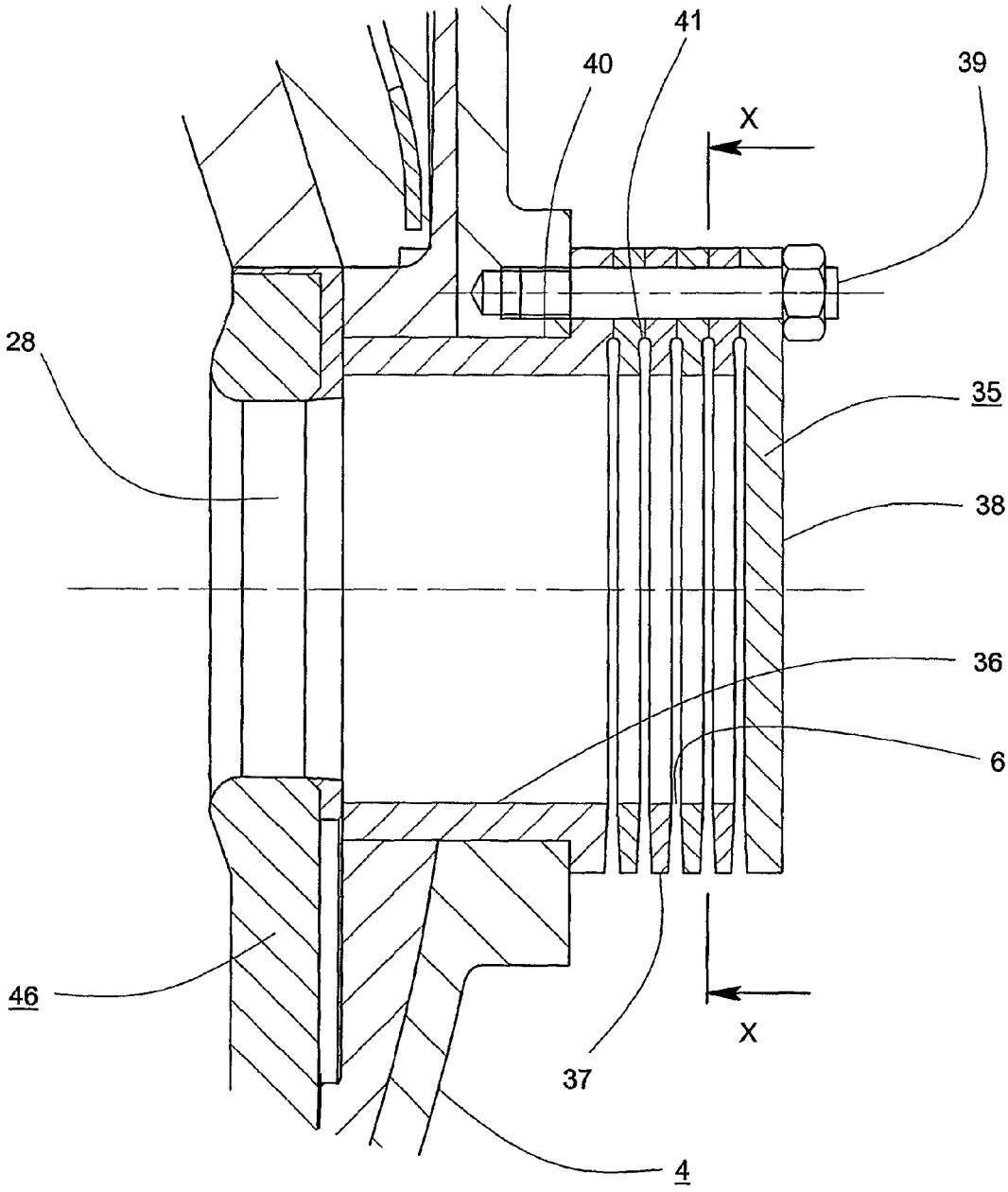
FIG. 6 is an enlarged sectional view through the longitudinal axis of a screening module.

While a unitary chamber construction can be employed, in the embodiment shown in FIGS. 3, 5 and 6, the grinding chamber 4 is a multi-component assembly, comprising upper casing members 23 and 24, and a lower chamber member 25, the members being secured together by fasteners (e.g. bolts). Upper and lower casing members 23, 24 and 25 can be provided with inner replaceable liners 26, 27 and 46, which are adapted to fit closely within the casing members, and protect them from damage by abrasive wear from grinding media, feed particles etc.

In addition, the lower chamber member 25 is itself a composite element comprising an outer metal structural casing 33 to which an elastomeric material is moulded and adhesively bonded thereto to form a thin inner layer 34. Structural casing 33 is typically formed of a thin walled metal, and is symmetrical about axis 2. The casing has a uniform cross-sectional shape transition from a substantially cylindrical form at its upper edge, to a substantially circular planar form, normal to axis 2, at its lower end. As a consequence of the thin wall of casing 33, and its manufacturing method, the profile of this member is subjected to relatively high manufacturing tolerances. The moulded elastomeric inner layer 34 is then intimately bonded to member 33 and provides an accurate inner surface profile 47 for uniform engagement with a replaceable chamber interior liner 46.

The members 23, 24 and 25 are structural elements, as they are required to absorb and transmit static and dynamic loads resulting from a reaction to grinding chamber contents 32, drive loads, and inertial loading as a consequence of the nutating motion. On the other hand, the liners 26, 27 and 46 are non structural members, and are instead selected to resist abrasive wear, and to protect structural casing members 23, 24 and 25 from the effects of wear, and to provide impact absorption.

Figure 7:
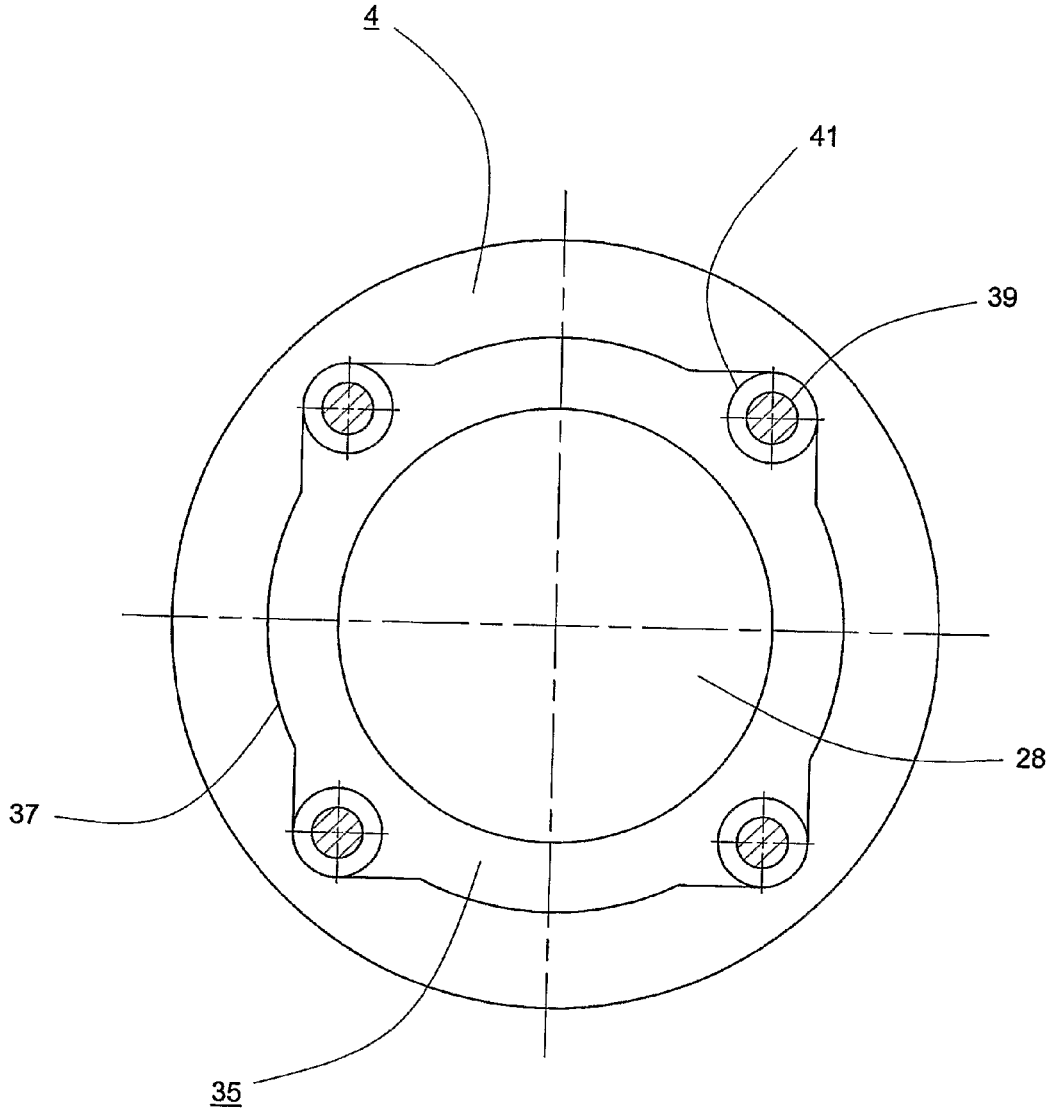
FIG. 7 is a section through the screening module shown in FIG. 6, taken on a plane normal to the longitudinal axis, as indicated by Section X-X.

Referring now to FIGS. 6 and 7, cross sectional views through a discharge passage 28 and screening module 35' are shown. The screening module 35 is mounted to the external wall of grinding chamber 4, and engages within opening 40 in the chamber wall. Typically the module is fabricated such that its longitudinal axis is coincident with an axis of discharge passage 28. A screening module 35 may be mounted at each discharge passage 28 of the grinding chamber 4.

The screening module 35 comprises a body insert 36 of tubular form that is shaped for snug positioning in opening 40. Body insert 36 has a length that enables it to project through the external wall of grinding chamber 4, to provide a lined discharge passage leading from liner member 46 and externally of the chamber.

Positioned in serial abutment to the insert 36 is a plurality of annular plates in the form of like annular disks 37. The annular disks are sandwiched (clamped) between insert 36 and a backing plate in the form of end plate 38, and are spaced from each other by a plurality of spacers 41, to define respective discharge openings 6 therebetween. The multiple discharge openings 6 thus have an annular-cylindrical form.

The maximum particle size of ground product discharged through openings 6 is determined by the axial dimension of each discharge opening 6. Thus, variation in product particle size can be obtained by varying the axial dimension of discharge openings 6. This can be achieved by replacing the annular disks 37 with the disks of appropriate geometry and/or by varying the dimensions of spacers 41. In addition, the total area of discharge openings 6 may be adjusted by varying the number of annular disks 37 mounted in the screening module 35 and/or by varying the dimensions of spacers 41.

The spacers 41 may comprise projections of circular form defined on (e.g. integral with) the surfaces of the annular disks 37. Alternatively, the spacers 41 may be provided as separate discrete elements located between adjacent annular disks 37, and may be of circular annular form (e.g. washers). In either case, the spacers 41 provide for axial spacing of the annular disks 37 to define the discharge openings 6, and to enable those openings to have closely controlled (or controllable) axial dimensions. In this regard, the spacer widths can be varied regularly, or irregularly, to provide variation in the size of the discharge openings 6 and thus axially variable particle (and particle size) discharge. This variation may even impart a curved profile to the discharge passage.

In addition, the spacers 41 can be formed from a resilient or flexible material that can deform or flex when particles impact on the annular disks 37 or end plate 38. This deformation or flexing can allow for reflection of oversize particles back to the grinding chamber, and it can allow for annular disk vibration and movement such that any blockage in the discharge openings 6 can be cleared (i.e. without requiring module dismantling).

To facilitate the sandwiching clamping) of the annular disks 37, and to fasten the module together and to the chamber wall, fasteners in the form of four evenly spaced bolts 39 (or pins) are provided. The bolts 39 engage and extend through respective aligned holes in the end plate 38, the annular disks 37 and the body insert 36, and into the external wall of grinding chamber 4. In this regard, a threaded end 39A of each bolt is received in an internally threaded recess 42 of the chamber wall, whereas a bolt head 43 (or nut) urges against the end plate 38. The bolts can be replaced with externally mounted clamps etc.

The bolts 39 and/or annular disks 37 can also be formed from resilient or flexible materials that can deform or flex when particles impact on the annular disks 37 or end plate 38, and again this can result in disk vibration, causing reflection of oversize particles to the grinding chamber and the clearing of any blockages in the discharge openings 6.

Each of the annular disks 37 depicted in FIGS. 6 and 7 has a thickness that reduces radially outwardly. As shown in FIG. 6, this yields a clearance between adjacent annular disks that increases moving radially outwards from the axis A. This increasing clearance assists with fine ground particle release from the screening module, once the particles initially pass through openings 6 (i.e. the openings flare outwardly, causing a pressure drop and hence partial vacuum that can draw particles through opening 6). However, some or all of the annular disk surfaces can be planar and parallel to adjacent annular disk surfaces.

FIG. 6 also shows an end surface 50 of body insert 36 and an inner surface 52 of end plate 38 having a conical profile to mirror those of the adjacent annular disks. Again, these end and inner surfaces can alternatively be planar.

In an optional embodiment secondary discharge openings can be provided through end plate 38, to permit discharge of fine ground particles from the screening module in a direction substantially parallel to its longitudinal axis. The secondary discharge openings can be of tubular form, and a variation in the product particle size discharged can be obtained by varying the aperture size of these secondary openings. As a further alternative, end plate 38 can be perforated or grate-like. The secondary discharge openings allow for a proportion of the fine particles travelling parallel to axis A to be discharged, but may then have the attendant problems of blockage.

Other embodiments may incorporate design variations to the embodiment shown in FIGS. 6 and 7 without affecting its principle of operation or performance. For example, whilst FIG. 6 shows a constant aperture size (internal diameter) through adjacent annular disks, this aperture size may be varied regularly or irregularly. For example, moving away from the chamber, a progressive decrease in the aperture size of successive annular disks can provide a slope to an internal passage of the screening module, and this slope can tend to cause oversize particles to be urged back into the grinding chamber. By having alternating larger and smaller aperture sizes differential disk vibration characteristics can be induced, which may also assist with particle discharge.

Variations in screening module internal passage shape can thus be selected and optimised to maximise fine ground particle discharge and oversize particle return to the grinding chamber. Having stated this, by providing a screening module internal passage shape that is cylindrical, the internal passage surface (i.e. in which the discharge openings 6 are located) is thus substantially parallel to the discharge direction of the grinding chamber contents (i.e. feed material of varying degrees of grinding and any grinding media). Hence surface pressures (at the internal passage surface and associated abrasive wear effects may be minimised.

Because a relatively large number of discharge openings 6 can be provided in the screening module 35, particularly favourable grinding to fine product sizes can be achieved and correspondingly narrow openings 6 can be employed, without compromising product discharge. Known screening grates have incorporated a screen plate occupying an area nominally corresponding with the diameter of a discharge passage (i.e. with the grate mounted transversely across the discharge passage). In the past, fine particle grinding has required very small openings in these screen grates, with the resultant chamber discharge not having high mechanical strength and being prone to blockage.

The screening module 35 allows for the available area of discharge to be increased, without compromising mechanical strength. In addition, the relatively low surface pressures associated with the screening module 35 results in reduced abrasive ear effects.

Further, the discharge of fine product material through openings 6 is assisted by the inertial effects of the nutating chamber motion, which can be operated at increased rates to dynamically expel the material from the interior of screening module 35. This contributes to a high unit flowrate capacity of the screening module 35.

In operation of the centrifugal grinding mill shown in FIG. 3, drive shaft 14 is rotationally driven by motor 15, and this rotation is converted to a nutating motion of the grinding chamber 4 by the eccentric stub shaft 19, the nutating motion being, constrained by opposing bearing surfaces 8 and 10, and 9 and 11, and being disposed about the point of notation symmetry 3.

As a consequence of the nutating motion, inertial reactions from the nutating assembly are transmitted to the support frame 7, via stationary bearing surfaces 10 and 11. The drive assembly located below the grinding chamber 4 is isolated from these inertial reactions by a resilient mounting through bearing 21.

Solid feed particles 31 are now fed into feed passage 5, where they fall under gravity into grinding chamber 4. The feed particles interact (collide) with loose solid particles of grinding media 32, and with other coarse particles of feed material, with a gyrating and tumbling action being imparted to all particles by the nutating motion of the grinding chamber 4. This causes the feed particles to be broken (ground; comminuted) down to finer size fractions. In some grinding applications, separate particles of grinding media 32 are not used, and breakage of particles to finer sizes results from particle-to-particle, and particle-to-wall interactions.

Fine size fractions of feed particles 31 are forced from grinding chamber 4 into discharge passage 28 in a discharge direction (approximately parallel to discharge axis A), and eventually the fine ground particles discharge through discharge openings 6 in the screening modules 35.

Thus, ground material finer than the dimension of discharge openings 6 passes therethrough, and material coarser than the dimension of discharge openings 6 is retained within (and typically returned to) the grinding chamber 4 where it undergoes further size reduction.

The mill shown in FIG. 3 can be employed as a wet grinding mill in which liquid, usually water, is also introduced into the grinding chamber 4, usually as a mixture with solid feed particles 31. Thus, fine product material discharges from the screening modules 35 in the form of a slurry, and drains to a central sump surrounding the drive shaft 14, from where it flows to a discharge pipe 42.

The centrifugal grinding mill can be adapted for use in dry grinding. In this case gas, usually air, is fed to the grinding chamber together with the feed particles 31, and discharged product issues from openings 6 as a suspension or stream of fine particles in the gas.

The drive mechanism, bearings and other moving parts are sealed effectively to prevent contamination from discharged product, whether in wet or dry form.

In the embodiment described, lubrication of bearings 17, 18, and 21 is provided by lubricant which is continuously recirculated through interconnecting passages in the rotating elements, including shafts 14 and 19. The recirculating lubricant provides cooling to remove any excessive heat generated in the bearings, and also removes contamination resulting from bearing wear and entry of extraneous particles. The lubricant discharging from the bearings may subsequently be filtered to remove contaminants, and may be cooled by heat exchange equipment as required, prior to recirculating it to the bearings.

It should be noted that the screening module can be employed with grinding chambers in mills other than centrifugal grinding mills, and may also be applied to a grinding chamber which is free to rotate about its axis (i.e. axis 2). In an alternative application, the rotational speed of such a grinding chamber about its axis can be a small proportion (e.g. about two percent) of the nutating speed of a centrifugal grinding mill.

It should also be noted that other variations can be made to the embodiments described, as would be understood by a person skilled in the art.

The invention claimed is:

1. A grinding mill chamber including:

a plurality of discharge passages, the discharge passages each positioned to receive ground particles moving thereinto in a different discharge direction; and a plurality of screening elements, each of the screening elements mounted at a different one of the plurality of discharge passages, each screening element comprising one or more screening element openings defined therein which are orientated such that ground particles passing through the discharge passage at which the screening element is mounted, pass through the screening element openings in a direction that is oblique with respect to the discharge direction for the discharge passage at which the screening element is mounted.

2. The grinding mill chamber as claimed in claim 1, wherein each of the one or more screening element openings of each screening element is itself orientated obliquely with respect to the discharge direction for the discharge passage at which the screening element is mounted.

3. The grinding mill chamber as claimed in claim 1, wherein the screening element opening(s) are sized such that coarse particles are prevented from discharging from the passage whereas fine ground particles are permitted to discharge from the passage.

4. The grinding mill chamber as claimed in claim 1, wherein a plurality of screening element openings are provided in each screening element.

5. The grinding mill chamber as claimed in claim 1, wherein each screening element comprises at least one annular plate mountable at the discharge passage, with a discharge passage backing plate being mountable adjacent to but spaced from the annular plate that is most remote from a chamber wall of the grinding mill chamber, and so as to define a screening element opening between the backing plate and adjacent annular plate and/or between the chamber wail and annular plate adjacent thereto.

6. The grinding mill chamber as claimed in claim 5, wherein a plurality of annular plates are mounted adjacent to but spaced from each other to define a plurality of screening element openings therebetween.

7. The grinding mill chamber as claimed in claim 5, wherein each of the backing and annular plates is of substantially lamina form.

8. The grinding mill chamber as claimed in claim 5, wherein the screening element is defined between the backing plate and the chamber wall, by fastening together the one or more annular plates and the backing plate using one or more fixing elements, with the one or more fixing elements clamping the one or more annular plates between the backing plate and the chamber wall.

9. The grinding mill chamber as claimed in claim 8, wherein each fixing element comprises an elongate pin or bolt extending through respective aligned holes in the one or more annular plates and the backing plate, with a proximal end of each pin or bolt being received at the backing plate, and a distal end of each pin or bolt being mountingly received in the chamber wall adjacent to the respective discharge passage.

10. The grinding mill chamber as claimed in claim 9, wherein the distal end of each pin or bolt is externally threaded for engagement in a respective threaded recess in the chamber wall adjacent to the discharge passage.

11. The grinding mill chamber as claimed in claim 9, wherein the one or more annular plates are spaced from each other, and/or wherein the backing plate and the annular plate adjacent thereto are spaced from each other, by one or more respective spacers which define one or more screening element openings between adjacent annular plates, and/or between the backing plate and the annular plate adjacent thereto, and/or between the chamber wall and annular plate adjacent thereto.

12. The grinding mill chamber as claimed in claim 11, wherein the one or more spacers are formed integrally with each plate, or are a plurality of washers discretely arranged in the space between and around the periphery of the one or more annular plates.

13. The grinding mill chamber as claimed in claim 12, wherein each washer is located on a respective elongate pin or bolt and is clamped between adjacent plates.

14. The grinding mill chamber as claimed in claim 11, wherein the spacers are arranged such that their thickness varies regularly or irregularly, to provide for control of and/or variation in the size of the or each screening element opening.

15. The grinding mill chamber as claimed in claim 5, wherein the plurality of annular plates is employed and is configured such that their internal diameter is varied regularly or irregularly.

16. The grinding mill chamber as claimed in claim 5, wherein the or each annular plate is formed from a resilient or flexile material that can deform or flex under particle impact.

17. The grinding mill chamber as claimed in claim 5, wherein the backing plate comprises a plurality of apertures of tubular form extending therethrough, and through which apertures fine ground particles can be released but coarse particles cannot.

18. The grinding mill chamber as claimed in claim 5, wherein the discharge passages each define an elongate axis therethrough, and wherein each of the one or more openings of the screening elements are orientated normal with respect to the elongate axis.

19. The grinding mill chamber as claimed in claim 18, wherein the or each annular plate and backing plate is spaced apart along the discharge passage elongate axis to define a series of annular screening element openings of cylindrical form that are symmetrical about the elongate axis.

20. A grinding mill comprising:

a grinding mill chamber that has:

a plurality of discharge passages, the discharge passages each positioned to receive ground particles moving thereinto in a different discharge direction; and a plurality of screening elements, each of the screening elements mounted at a different one of the plurality of discharge passages, each screening element comprising one or more screening element openings defined therein which are orientated such that ground particles passing through the discharge passage at which the screening element is mounted, pass through the screening element openings in a direction that is oblique with respect to the discharge direction for the discharge passage at which the screening element is mounted;

a support for supporting the grinding mill chamber;

a feed passage in communication with the grinding mill chamber for directing into the grinding mill chamber a feed to be ground; and a drive mechanism coupled to drive the grinding mill chamber in a manner that causes any grinding media and/or the feed in the grinding mill chamber to grind the feed and produce the ground particles for discharge in the discharge directions.

* * * * *